US010465477B2

(12) United States Patent
Abdelaziz et al.

(10) Patent No.: US 10,465,477 B2
(45) Date of Patent: Nov. 5, 2019

(54) SUBSURFACE SAFETY VALVE FOR CABLE DEPLOYED ELECTRICAL SUBMERSIBLE PUMP

(71) Applicant: Saudi Arabian Oil Company, Dhahran (SA)

(72) Inventors: Mohannad Abdelaziz, Dhahran (SA); Brian A. Roth, Dhahran (SA); Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 139 days.

(21) Appl. No.: 15/667,780

(22) Filed: Aug. 3, 2017

(65) Prior Publication Data

US 2018/0135384 A1 May 17, 2018

Related U.S. Application Data

(60) Provisional application No. 62/423,308, filed on Nov. 17, 2016.

(51) Int. Cl.

| | |
|---|---|
| ***E21B 33/12*** | (2006.01) |
| ***E21B 34/08*** | (2006.01) |
| ***E21B 34/10*** | (2006.01) |
| ***E21B 43/12*** | (2006.01) |
| ***E21B 34/06*** | (2006.01) |
| *E21B 34/14* | (2006.01) |

(Continued)

(52) U.S. Cl.

CPC ..... *E21B 34/102* (2013.01); *E21B 34/06* (2013.01); *E21B 34/105* (2013.01); *E21B 43/128* (2013.01); *E21B 34/066* (2013.01); *E21B 34/14* (2013.01); *E21B 43/105* (2013.01); *E21B 2034/007* (2013.01)

(58) Field of Classification Search

CPC ..... E21B 33/12; E21B 34/08; E21B 34/102
USPC ..... 166/147, 151, 129
See application file for complete search history.

(56) References Cited

U.S. PATENT DOCUMENTS 3,594,701 A * 7/1971 Ramsey ..... H01R 4/70 174/47
4,331,315 A 5/1982 Geisow (Continued)

OTHER PUBLICATIONS

International Search Report and Written Opinion for International Application No. PCT/US2017/062159; report dated Feb. 15, 2018; 13 pages.

*Primary Examiner* — Cathleen R Hutchins
(74) *Attorney, Agent, or Firm* — Bracewell LLP; Constance G. Rhebergen; Linda L. Morgan

(57) ABSTRACT

A safety valve system for a subterranean well includes a central body with a central body profile and a supporting body having a supporting profile shaped to support the central body profile. An outer diameter seal circumscribes the central body to seal between the central body and the supporting body. An inner diameter seal is located within a central bore of the central body to form a seal between the central bore of the central body and a cable that extends through the central bore. An annular fluid flow path extends through the safety valve system axially past the outer diameter seal and the inner diameter seal. A valve assembly is moveable between an open position where fluid can flow through the annular fluid flow path, and a closed position where fluid is prevented from flowing through the annular fluid flow path.

25 Claims, 5 Drawing Sheets

(51) Int. Cl.
*E21B 43/10* (2006.01)
*E21B 34/00* (2006.01)

(56) References Cited

U.S. PATENT DOCUMENTS

| | | | | |
|---|---|---|---|---|
| 4,340,088 | A | 7/1982 | Geisow | |
| 4,461,353 | A | 7/1984 | Vinzant et al. | |
| 4,621,689 | A | 11/1986 | Brookbank, III | |
| 4,658,904 | A | 4/1987 | Doremus et al. | |
| 6,234,247 | B1 | 5/2001 | Head | |
| 6,866,095 | B2 | 3/2005 | Skeels | |
| 7,195,072 | B2 | 3/2007 | MacKay et al. | |
| 7,891,428 | B2 | 2/2011 | Martin et al. | |
| 9,587,462 | B2 | 3/2017 | Giusti, Jr. et al. | |
| 2009/0001304 | A1 | 1/2009 | Hansen et al. | |
| 2012/0273055 | A1 | 11/2012 | Lirette et al. | |
| 2014/0048277 | A1* | 2/2014 | June | E21B 33/035 166/348 |
| 2014/0083712 | A1 | 3/2014 | Vick et al. | |
| 2014/0096978 | A1 | 4/2014 | Giusti, Jr. et al. | |
| 2014/0110122 | A1 | 4/2014 | Henschel et al. | |
| 2015/0354315 | A1* | 12/2015 | Windegaard | E21B 33/1208 166/374 |

* cited by examiner

SUBSURFACE SAFETY VALVE FOR CABLE DEPLOYED ELECTRICAL SUBMERSIBLE PUMP

CROSS REFERENCE TO RELATED APPLICATION

This application claims priority to and the benefit of U.S. Provisional Application Ser. No. 62/423,308, filed Nov. 17, 2016, titled "Subsurface Safety Valve For Cable Deployed Electrical Submersible Pump," the full disclosure of which is incorporated herein by reference in its entirety for all purposes.

BACKGROUND OF THE DISCLOSURE

1. Field of the Disclosure

This disclosure relates generally to subsurface safety valves in subterranean wells and in particular, to subsurface safety valves used in conjunction with electrical submersible pumps.

2. Description of the Related Art

One method of producing hydrocarbon fluid from a well bore that lacks sufficient internal pressure for natural production is to utilize an artificial lift method such as an electrical submersible pump. In some types of electrical submersible pumping systems, a cable can suspend the submersible pumping device near the bottom of the well bore proximate to the producing formation. The submersible pumping device is operable to retrieve production zone fluid, impart a higher pressure into the fluid and discharge the pressurized production zone fluid into production tubing. Pressurized well bore fluid rises towards the surface motivated by difference in pressure.

A surface controlled sub-surface safety valve (SCSSV) can be used in the wellbore to provide closure of the production tubing, such as in a case of an emergency. Deep-set SCSSVs can be utilized below the electrical submersible pumping systems or other downhole apparatus. However, installing a SCSSV at such a deep depth results in a significant volume of hydrocarbons located within the subterranean well above the SCSSV. In addition, having a deep-set SCSSV can require a very large surface hydraulic power system to operate.

Placing the SCSSV above the electrical submersible pumping systems can require splicing the cable that is supporting the submersible pumping device in order for the cable to pass by the surface controlled sub-surface safety valve, which can cause an unreliable or weak point in the cable. For example, one current method includes routing the cable around the completion tubular. Another significant disadvantage for this method is the difficulty in achieving the correct space out and termination points. Electrical splices and connections are particularly unreliable in the production environment.

Another current method is to pass the cable through the SCSSV directly. The cable can be spliced with the SCSSV flow path routed around it. While there are fewer electrical splices and connections to be made in the production environment, issues relating to space out and termination of the cable at the SCSSV remain.

In alternate current systems, the surface controlled subsurface safety valve can be a flapper, split or clamshell type device that closes around the cable. However, in such systems the alignment and centralization of the cable can be difficult and the sealing area between the two or more segments and between the segments and the cable is greater, increasing the potential for leakage and making it a challenge to provide a zero leak seal due to manufacturing tolerances.

SUMMARY OF THE DISCLOSURE

Embodiments disclosed herein provide a safety valve system axially above the downhole apparatus, such as an electrical submersible pump assembly, with the cable run through the center of the safety valve system and connected to the downhole apparatus. Once the safety valve system reaches the desired location the safety valve system will lock into place and disconnect from the downhole apparatus, and the downhole apparatus will be further lowered towards its planned depth. After the rig-less installation of the downhole apparatus is completed, an inner diameter seal of the safety valve system can be energized to seal against the cable and divert the fluid flow to an annular fluid flow path in the safety valve system. The annular flow path can have a valve assembly that can control the on and off operation of the valve.

In an embodiment of this disclosure, a safety valve system for a subterranean well has a central body with a central body profile on an outer diameter of the central body. A supporting body has a supporting profile on an inner diameter that is shaped to mate with and support the central body profile of the central body. An outer diameter seal circumscribes the central body and is positioned to seal between the central body and the supporting body. An inner diameter seal is located within a central bore of the central body, the inner diameter seal moveable between an unenergized position and an energized position where the inner diameter seal forms a seal between the central bore of the central body and a cable that extends through the central bore. An annular fluid flow path extends through the safety valve system axially past the outer diameter seal and the inner diameter seal. A valve assembly is moveable between an open position where fluid can flow through the annular fluid flow path, and a closed position where fluid is prevented from flowing through the annular fluid flow path.

In alternate embodiments when in the unenergized position, the inner diameter seal can be positioned to allow relative axial movement between the inner diameter seal and the cable. When in the energized position, the inner diameter seal can remain axially static relative to the cable and the cable can be axially moveable relative to the central body. The valve assembly can be a sleeve assembly that includes an inner seal energizer moveable from an unengaged position to an engaged position, wherein in the engaged position the inner seal energizer maintains the inner diameter seal in an energized position.

In other alternate embodiments, the annular fluid flow path can be radially outward of the inner diameter seal and radially inward of the outer diameter seal, or alternately, the annular fluid flow path can be radially outward of the inner diameter seal and radially outward of the outer diameter seal. The a supporting body can have a central passage with an inner diameter that is greater than an outer diameter of a downhole apparatus located at the end of the cable. A lock can be located around an outer diameter of the central body, the lock moveable between a retracted position and an extended position, wherein in the expanded condition the lock prevents relative axial movement between the central body and the supporting body. The supporting body can be a part of a production tubing extending into the subterranean well.

In an alternate embodiment of this disclosure, a subterranean hydrocarbon development system having a safety valve system can include a production tubing extending into a subterranean well. A downhole apparatus is suspended within the production tubing by a cable. The safety valve system is located axially above the downhole apparatus, the safety valve system having a central body with a central body profile on an outer diameter of the central body. The safety valve system also has a supporting body having a supporting profile on an inner diameter that is shaped to mate with and support the central body profile of the central body, the supporting body being a part of the production tubing. The safety valve system further has an outer diameter seal circumscribing the central body and positioned to seal between the central body and the supporting body. An inner diameter seal is located within a central bore of the central body, the inner diameter seal moveable between an unenergized position and an energized position where the inner diameter seal forms a seal between the central bore of the central body and the cable. An annular fluid flow path extends through the safety valve system axially past the outer diameter seal and the inner diameter seal. A valve assembly is moveable between an open position where fluid can flow through the annular fluid flow path, and a closed position where fluid is prevented from flowing through the annular fluid flow path.

In alternate embodiments, a lock can be located around an outer diameter of the central body, the lock moveable between a retracted position and an extended position, wherein in the expanded condition the lock prevents relative axial movement between the central body and the supporting body. A maximum outer diameter of the central body profile with the lock in the retracted position can be greater than a minimum inner diameter of the supporting profile.

In other alternate embodiments, when in the unenergized position, the inner diameter seal can be positioned to allow relative axial movement between the cable and the production tubing with the central body profile of the central body supported by the supporting profile of the supporting body. When in the energized position, the inner diameter seal can remain axially static relative to the cable and the cable is axial moveable relative to the central body. The annular fluid flow path can extend through the central body or alternately through the supporting body. The valve assembly can be a sleeve assembly that includes an inner seal energizer moveable from an unengaged position to an engaged position, wherein in the engaged position the inner seal energizer maintains the inner diameter seal in an energized position during operation of the downhole apparatus.

In yet another alternate embodiment of this disclosure, a method of developing a subterranean well using a safety valve system includes lowering a central body having a central body profile on an outer diameter of the central body into the subterranean well. The central body can be landed on a supporting profile on an inner diameter of a supporting body, the supporting profile shaped to mate with and support the central body profile of the central body. An outer diameter seal that circumscribes the central body can seal between the central body and the supporting body. An inner diameter seal that is located within a central bore of the central body can be moved from an unenergized position to an energized position to form a seal between the central bore of the central body and a cable that extends through the central bore. A valve assembly can be moved from a closed position where fluid is prevented from flowing through an annular fluid flow path, to an open position so that fluid can flow through the annular fluid flow path, wherein the an annular fluid flow path extends through the safety valve system axially past the outer diameter seal and the inner diameter seal.

In alternate embodiments, moving the valve assembly from the closed position to the open position can include providing a hydraulic pressure to the valve assembly. Reducing the hydraulic pressure can cause the valve assembly to move to the closed position. When in the unenergized position, the inner diameter seal can allow for relative axial movement between the inner diameter seal and the cable. When in the energized position the inner diameter seal can remain axially static relative to the cable and the cable can be axial moveable relative to the central body.

In other alternate embodiments, the fluid flow path can extend radially outward of the inner diameter seal, radially inward of the outer diameter seal and through the central body. Alternately, the annular fluid flow path can extend radially outward of the inner diameter seal, radially outward of the outer diameter seal, and through the supporting body. A block located around an outer diameter of the central body can be moved from a retracted position to an extended position to prevent relative axial movement between the central body and the supporting body.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
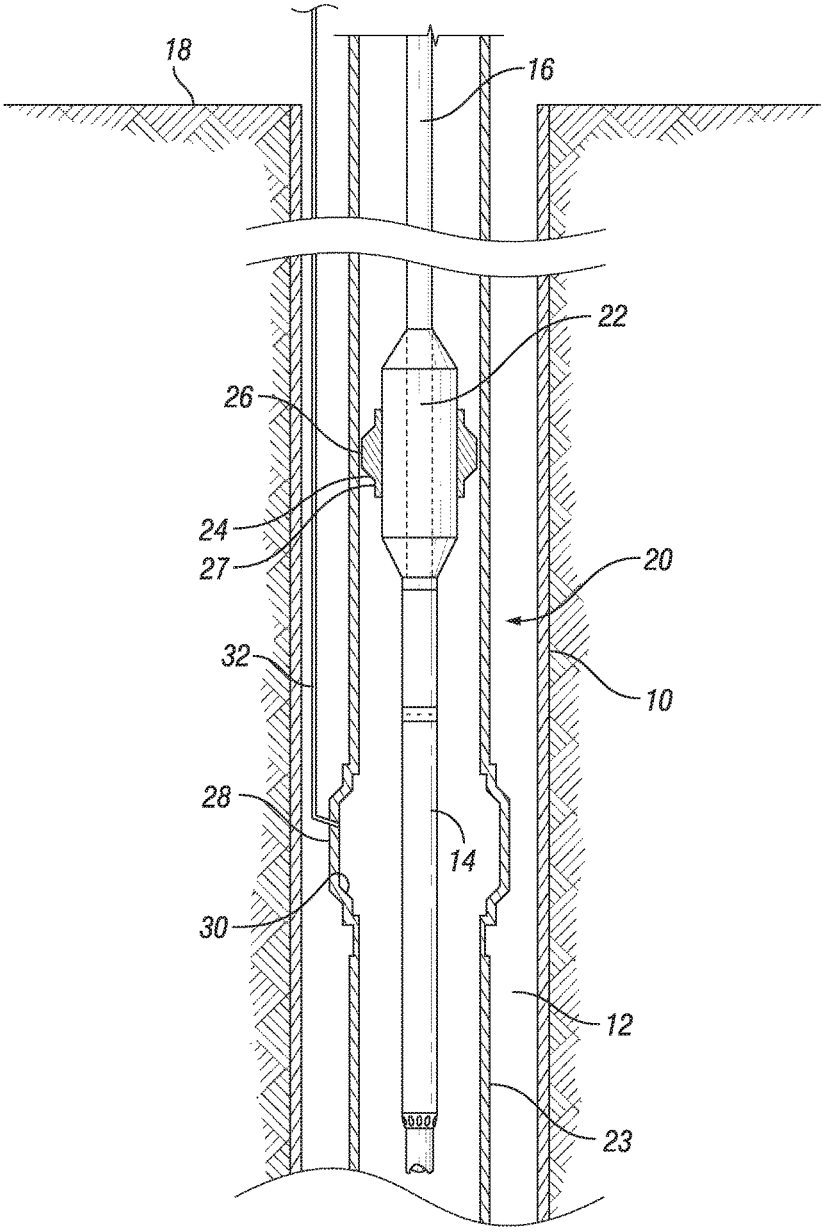
FIG. 1 is a section view of a safety valve system shown with a central body being lowered into a subterranean well, in accordance with an embodiment of this disclosure.

Looking at FIG. 1, subterranean well 10 includes wellbore 12. A downhole apparatus 14 is located within wellbore 12. In the example shown, downhole apparatus 14 is an electrical submersible pump assembly that can include a motor that is used to drive a pump and a seal section located between the motor and pump for equalizing pressure within electrical submersible pump assembly with that of wellbore 12. Downhole apparatus 14 can be lowered into wellbore 12 and suspended within wellbore 12 with cable 16.

A cable deployed downhole apparatus 14, such as a cable deployed electrical submersible pump is advantageous because it does not require utilizing a conventional workover rig whenever a change-out of downhole apparatus 14 is required, but instead downhole apparatus 14 can be pulled by a less costly coiled tubing rig. Cable deployed downhole apparatus 14 can be deployed through an installed completion with cable 16 that can provide both electrical power to downhole apparatus 14 and the strength to carry downhole apparatus 14 to the depth at which downhole apparatus 14 will be set. The setting depth of downhole apparatus 14 may be thousands of feet below surface 18.

Within some subterranean wells, and in particular within subterranean well 10 in which downhole apparatus 14 is an electrical submersible pump assembly, an SCSSV can be used to protect the environment from the uncontrolled release of hydrocarbons. An SCSSV is designed to provide fail-safe control of the well. Embodiments of this disclosure provide alternate means to provide an SCSSV in the form of safety valve system 20 that is set axially above the ESP. Safety valve system 20 can be set several hundred feet below the wellhead as opposed to a deep-set SCSSV that is set several thousand feet below the wellhead. Using safety valve system 20 of this disclosure can reduce the volume of hydrocarbons located above safety valve system 20. Safety valve system 20 can close and seal around cable 16 that is used to deploy and power downhole apparatus 14.

Looking at FIG. 1, safety valve system 20 includes central body 22. Central body 22 is a generally tubular shaped member with a central body bore extending through central body 22. Cable 16 can pass through the central body bore of central body 22. In FIG. 1, central body 22 is being conveyed down production tubing 23 in connection with downhole apparatus 14. Central body 22 can rest on top of downhole apparatus 14 and can be physically attached to downhole apparatus 14 or to a sub attached to cable 16 above downhole apparatus 14. The attachment can be made with, for example, a shear mechanism such as shear pins or screws, or a resettable mechanism such as a C-ring, detent ring, J-slot, or other known connection mechanism.

Central body profile 24 can also be part of an outer diameter seal 27 circumscribing central body 22 and positioned to seal between central body 22 and supporting body 28. In the example embodiments shown, supporting body 28 is integrally formed with (FIGS. 1-2), or a separate member that is attached to and made a part of (FIGS. 3-4), production tubing 23. Supporting body 28 has supporting profile 30 on an inner diameter that is shaped to mate with and support central body profile 24 of central body 22. Supporting body 28 has a central passage with an inner diameter that is greater than an outer diameter of downhole apparatus 14, which is located at the end of cable 16.

Central body profile 24 can also be part of lock 26 that is located around the outer diameter of central body 22. As an example, supporting profile 30 can be a ported nipple with a recess and no-go. Supporting profile 30 can include a honed and polished sealbore to allow outer diameter seal 27 of central body 22 to not only land and lock into supporting profile 30, but also to seal off with a packing stack. Hydraulic control line 32 can extend from supporting profile 30 to surface 18. Hydraulic control line 32 will provide hydraulic pressure to safety valve system after central body 22 has been landed in supporting body 28.

Downhole apparatus 14 is retained in central body profile 24 through the extension of locking dogs of lock 26 of central body profile 24 from a retracted position (FIGS. 1 and 3) to an extended position (FIGS. 2 and 4) upon properly landing central body profile 24 on supporting profile 30. The locking dogs of lock 26 are held in a retracted position while lowering central body 22 through production tubing 23 so that central body profile 24 can pass through production tubing 23. A maximum outer diameter of central body profile 24 with lock 26 in the retracted position is greater than a minimum inner diameter of supporting profile 30 at the no-go so that downhole apparatus 14 is prevented from being lowered past supporting profile 30. In the expanded condition lock 26 prevents relative axial movement between central body 22 and supporting body 28.

Setting of the locking dogs of lock 26 can be by hydraulic, mechanical, or electrical means. Hydraulic setting could be accomplished with common hydraulic control line 32 or could be a separate dedicated control line to surface 18. Hydraulic pressure would act on a piston to move the locking dog mandrel from a disengaged to an engaged position. Alternately, electrical power could energize the locking dog mandrel from a disengaged to engaged position. Mechanical setting of the dogs with the locking dog mandrel would be accomplished by a staged event such that during deployment, loss of weight on the cable weight indicator would signal that central body 22 has landed on the no go of supporting profile 30.

Figure 2:
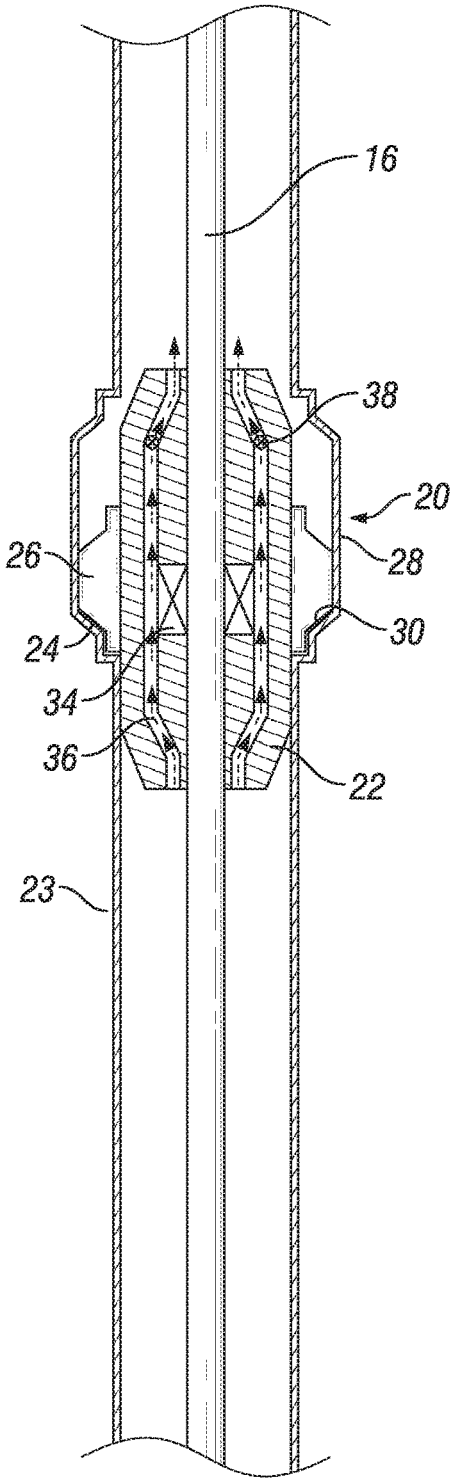
FIG. 2 is a section view of the safety valve system of FIG. 1, shown with the central body landed in a supporting body, in accordance with an embodiment of this disclosure.

Looking at FIG. 2, after central body 22 has be landed on supporting profile 30, central body 22 can be released from downhole apparatus 14 and cable 16 could continue to travel downward. As an example, downward movement of downhole apparatus 14 could shear off the shear mechanism or a resettable mechanism can be disengaged so that cable 16 and downhole apparatus 14 can continue downward within subterranean well 10 unimpeded while central body 22 remains within supporting body 28.

Safety valve system 20 further includes inner diameter seal 34 located within a central bore of central body 22. Inner diameter seal 34 is moveable between an unenergized position and an energized position. In the unenergized position, inner diameter seal 34 is positioned to allow relative axial movement between inner diameter seal 34 and cable 16. Therefore when inner diameter seal 34 is in the unenergized position, inner diameter seal 34 is positioned to allow relative axial movement between cable 16 and production tubing 23 with central body profile 24 of central body 22 supported by supporting profile 30 of supporting body 28 so that downhole apparatus 14 and cable 16 can move further downward within subterranean well 10 unimpeded while central body 22 remains within supporting body 28.

After downhole apparatus 14 has reached its desired depth, inner diameter seal 34 can be moved to the energized position. In the energized position, the inner diameter seal 34 forms a seal between the central bore of central body 22 and cable 16 that extends through the central bore. Inner diameter seal 34 can be regular elastomer material or a swellable elastomer material that can be designed to swell in water, or oil, or both. A thin Teflon® sleeve on the inner diameter of the elastomer material can provide a low friction coefficient interface between the elastomer inner diameter and an outer diameter of cable 16, allowing downhole apparatus 14 and cable 16 deployment to depth. In another embodiment inner diameter seal 34 can utilize shape memory materials to create the seal on cable 16.

Figure 5:
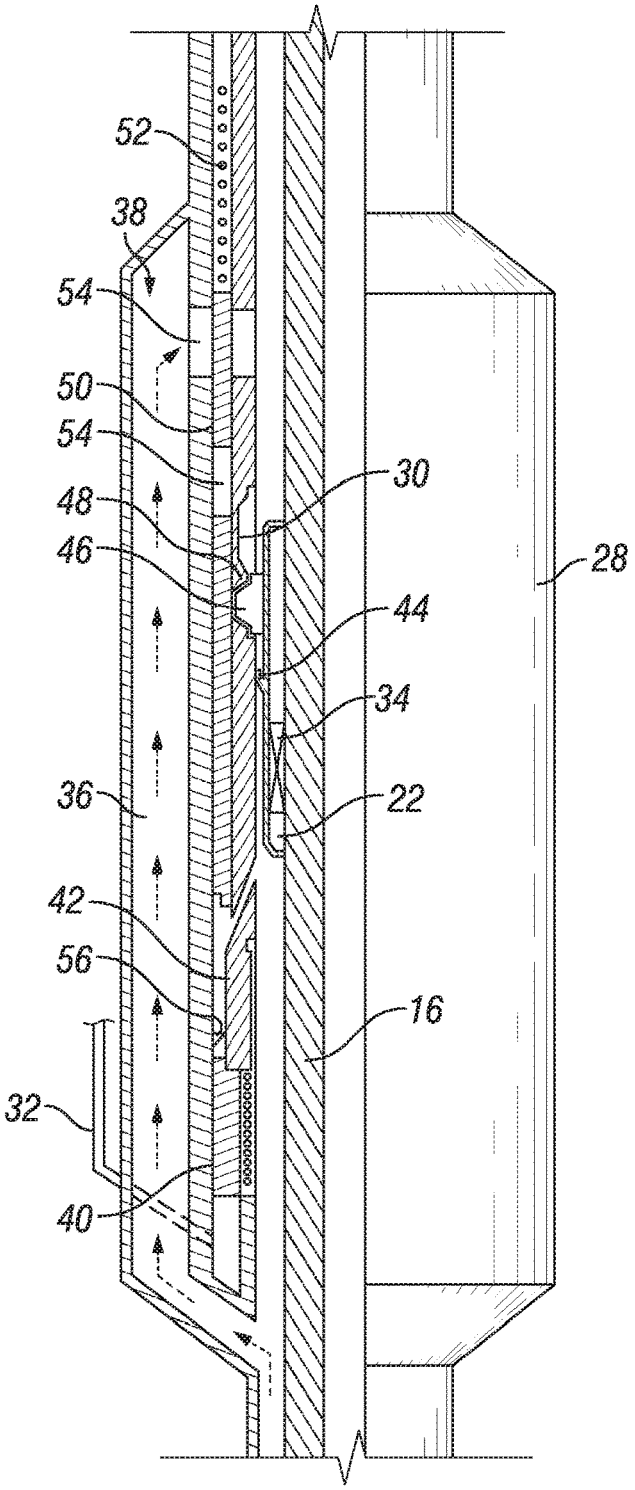
FIG. 5 is a partial section view of a safety valve system, shown with an inner diameter seal in an unenergized position and valve assembly in a closed position, in accordance with an embodiment of this disclosure.

Alternately as shown in FIG. 5, inner diameter seal 34 can be compressed to seal against cable 16 with hydraulic pressure supplied by hydraulic control line 32 in communication with a hydraulic system at surface 18. In each embodiment, inner diameter seal 34, once set, remains fully energized preventing fluid flow by cable 16 until safety valve system 20 is removed from subterranean well 10. In order to provide a fail-safe operation, inner diameter seal 34 can be locked in place, for example with a shear-pin or spring load so the sealing against cable 16 is maintained even if the hydraulic pressure is lost.

Figure 3:
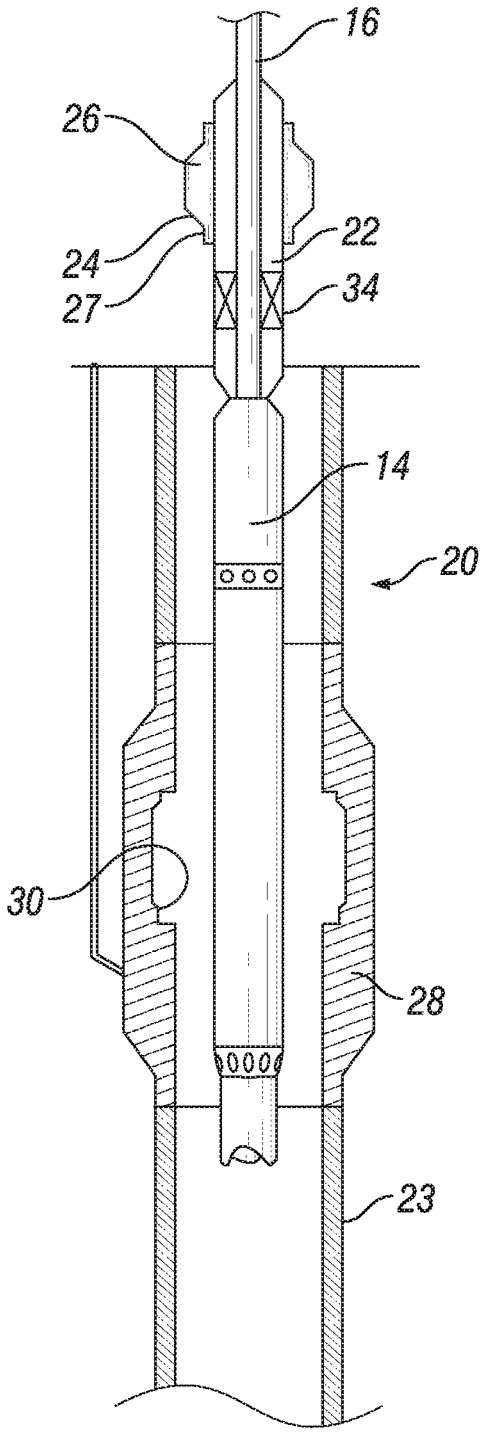
FIG. 3 is a section view of a safety valve system shown with a central body being lowered into a subterranean well, in accordance with an embodiment of this disclosure.
Figure 4:
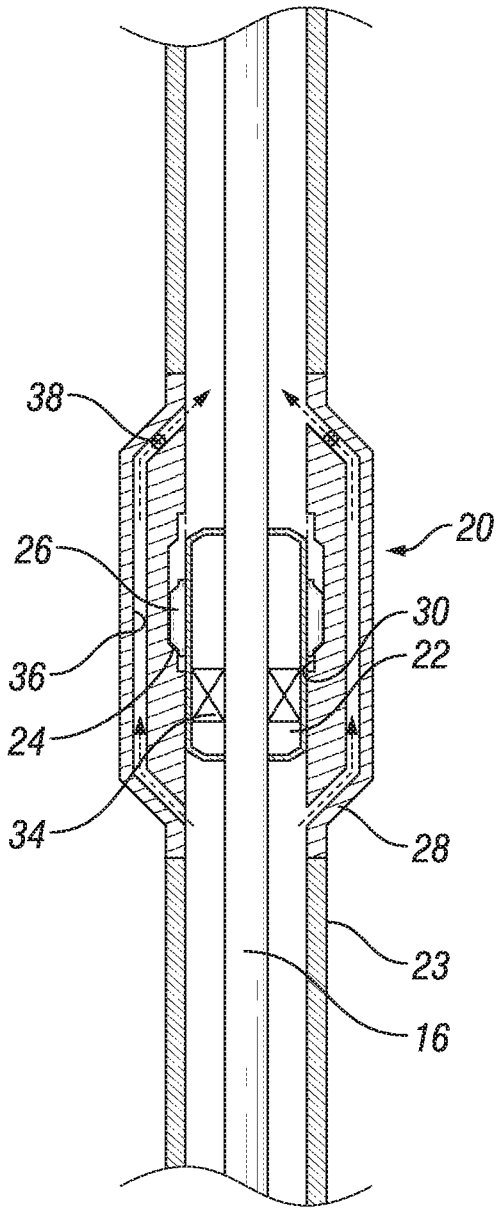
FIG. 4 is a section view of the safety valve system of FIG. 3, shown with the central body landed in a supporting body, in accordance with an embodiment of this disclosure.

With inner diameter seal 34 sealing between cable 16 and central body 22 and outer diameter seal 27 sealing between central body 22 and supporting body 28, fluid within wellbore 12 is directed through annular fluid flow path 36 that extends through safety valve system 20 axially past outer diameter seal 27 and inner diameter seal 34. In the embodiment of FIGS. 1-2, annular fluid flow path 36 extends through central body 22. In such an embodiment, annular fluid flow path 36 is radially outward of inner diameter seal 34 and radially inward of outer diameter seal 27. In the embodiment of FIGS. 3-4, annular fluid flow path 36 extends through supporting body 28. In such an embodiment, annular fluid flow path 36 is radially outward of inner diameter seal 34 and radially outward of outer diameter seal 27.

Valve assembly 38 can be used to control the flow of fluid past safety valve system 20. Valve assembly 38 is moveable between an open position where fluid can flow through the annular fluid flow path 36, and a closed position where fluid is prevented from flowing through the annular fluid flow path 36. Hydraulic pressure delivered through hydraulic control line 32 opens the valve assembly 38, allowing flow through the valve assembly 38 by way of annular fluid flow path 36. Release of pressure in hydraulic control line 32 causes valve assembly 38 to close, shutting off the flow of hydrocarbons.

One example of a valve assembly 38 is shown in FIG. 5. Looking at FIG. 5, supporting body 28 is shown with a sample valve assembly 38. Valve assembly 38 is in a closed position, blocking the flow of fluids past valve assembly 38. In FIG. 5, inner diameter seal 34 is also not energized. Hydraulic control line 32 can be used as a main control mechanism for activating the inner diameter seal 34, for opening of the valve assembly 38, and retrieval of safety valve system 20. In such an embodiment, a different level of pressure can operate each of such functions. For example, a higher initial pressure can be used to set inner diameter seal 34 and lock inner diameter seal 34 in place, then hydraulics can be diverted to open the closure mechanism. Control line pressure can be provided after this to open the closure-mechanism. At low pressures, hydraulic control line 32 can open the full-bore valve, which will be maintained during the whole rig-less operation. This system can be alternately coupled with electrical line or by increasing the number of control lines to facilitate the downhole design.

In the example of FIG. 5, when hydraulic control line 32 is pressurized, block 40 moves axially upward, moving inner seal energizer 42 from an unengaged position to an engaged position. This will cause inner diameter seal 34 to form a seal against cable 16. Inner seal energizer 42 will move axially until the groove in inner seal energizer 42 latches on to snap ring 44. Snap ring 44 will retain inner seal energizer 42 so that inner seal energizer 42 maintains inner diameter seal 34 in an energized position. While inner seal energizer 42 is energizing inner diameter seal 34, latch 46, which can be part of lock 26 and is restricted by shoulder 48, will keep inner seal energizer 42 and inner diameter seal 34 in place. Applied axial forces can reach sufficient levels to shear shoulder 48. After shoulder 48 is sheared, inner diameter seal 34 remains axially static relative to cable 16, however cable 16 is axial moveable relative to central body 22 by the movement of latch 46 within extended supporting profile 30. This will allow limited axial movement of cable 16 during the production life of subterranean well 10 due to, for example, thermal expansion effects as hot hydrocarbons are produced from the reservoir, or if a short pull of the cable is required, for example to attach the top of the coil to a crane for to change connect or to perform over-pull for retrieval. An extreme case will be if the wellhead is subjected to a force that knocks it off and causes limited axial motion of the cable in such a way that the integrity of safety valve system 20 might be affected. If cable 16 is able to have limited axial motion then these effects can be reduced.

Providing additional hydraulic pressure by way of hydraulic control line 32 will cause block 40 to meet with valve sleeve 50 so that linear motion of valve sleeve 50 against spring 52 aligns the openings 54 and allows the flow of fluid to pass through to production tubing 23 above central body 22. Block snap ring 56 can be added to restrict the motion of block 40. Spring 52 can maintain safety valve system 20 in the normally closed position by urging valve sleeve 50 in a way that openings 54 are out of alignment.

Valve sleeve 50 can move axially to align openings 54 or can rotate to align openings 54. An advantage of rotating valve sleeve 50 is that such embodiment is more debris tolerant because there is a larger potential opening area, and the rotational mechanism could shear any stuck debris. Openings 54 can have a variety of shapes such as a circle or oval.

In order to retrieve central body 22, locking dogs of lock 26 can be retracted from supporting profile 30. If central body 22 is being retrieved on cable 16, then inner diameter seal 34 can remain in the energized position.

If there are times when there is no cable 16 in subterranean well 10, then a modified central body that acts as a plug (completely sealed-off) can be installed inside the supporting body. Another solution is to install separate SCSSV in series with safety valve system 20. The separate SCSSV can be a currently available valve system or can utilize the same closure mechanism of this disclosure.

Therefore systems and methods described herein provide sealing against cable 16 and a fail-safe closure mechanism for the annular fluid flow path 36. The shallow-set safety valve system 20 can be retrieved without the need for a conventional workover rig when there is need for repair or replacement. Embodiments of this disclosure allow limited axial movement of cable 16 to account for thermal expansion of cable 16, and can account for extreme cases of knocking-off the wellhead. Safety valve systems described herein can also be compatible with optional full-bore closure when cable 16 is not present.

Although systems and methods have been described for use herein for use with an electrical submersible pumping assembly, the SCSSV can be equally useful for other wellbore cable deployed tools and equipment including, for example, downhole apparatus that use an aggregate solid core, such as well heaters.

Therefore, as disclosed herein, embodiments of the systems and methods of this disclosure will provide cost savings relative to current electrical submersible pumping assemblies due to simpler and faster installation operations which can be handled rig-less by only two crew members. Embodiments of this disclosure can be deployed in a variety of well types, including those with either high or low gas oil ratios. Systems and methods herein can reduce well downtime and human errors and provide for efficient workovers and improve production retention.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A safety valve system for a subterranean well, the safety valve system having:

a central body with a central body profile on an outer diameter of the central body;

a supporting body located downhole within the subterranean well and having a supporting profile on an inner diameter that is shaped to mate with and support the central body profile of the central body;

an outer diameter seal circumscribing the central body and positioned to seal between the central body and the supporting body;

an inner diameter seal located within a central bore of the central body, the inner diameter seal moveable between an unenergized position and an energized position where the inner diameter seal forms a seal between the central bore of the central body and a cable that extends through the central bore, where the cable is sized to move axially through the central bore of the central body to lower the downhole apparatus within the subterranean well, and is operable to support the weight of the downhole apparatus within the subterranean well;

an annular fluid flow path extending through the safety valve system axially past the outer diameter seal and the inner diameter seal; and a valve assembly moveable between an open position where fluid can flow through the annular fluid flow path, and a closed position where fluid is prevented from flowing through the annular fluid flow path.

2. The safety valve system of claim 1, wherein in the unenergized position the inner diameter seal is positioned to allow relative axial movement between the inner diameter seal and the cable.

3. The safety valve system of claim 1, wherein in the energized position the inner diameter seal remains axially static relative to the cable and the cable is axially moveable relative to the central body.

4. The safety valve system of claim 1, wherein the valve assembly is a sleeve assembly that includes an inner seal energizer moveable from an unengaged position to an engaged position, wherein in the engaged position the inner seal energizer maintains the inner diameter seal in the energized position.

5. The safety valve system of claim 1, wherein the annular fluid flow path is radially outward of the inner diameter seal and radially inward of the outer diameter seal.

6. The safety valve system of claim 1, wherein the annular fluid flow path is radially outward of the inner diameter seal and radially outward of the outer diameter seal.

7. The safety valve system of claim 1, wherein the supporting body has a central passage with an inner diameter that is greater than an outer diameter of the downhole apparatus located at an end of the cable.

8. The safety valve system of claim 1, further including a lock located around the outer diameter of the central body, the lock moveable between a retracted position and an extended position, wherein in the extended position the lock prevents relative axial movement between the central body and the supporting body.

9. The safety valve system of claim 1, wherein the supporting body is a part of a production tubing extending into the subterranean well.

10. A subterranean hydrocarbon development system having a safety valve system, the subterranean hydrocarbon development system having:

a production tubing extending into a subterranean well;

a downhole apparatus suspended within the production tubing by a cable, the cable supporting the weight of the downhole apparatus within the subterranean well;

the safety valve system located downhole within the subterranean well axially above the downhole apparatus, the safety valve system having:

a central body with a central body profile on an outer diameter of the central body, a supporting body having a supporting profile on an inner diameter that is shaped to mate with and support the central body profile of the central body, the supporting body being a part of the production tubing located within the subterranean well;

an outer diameter seal circumscribing the central body and positioned to seal between the central body and the supporting body;

an inner diameter seal located within a central bore of the central body, the inner diameter seal moveable between an unenergized position and an energized position where the inner diameter seal forms a seal between the central bore of the central body and the cable the cable sized to move axially through the central bore of the central body when the inner diameter seal is in an unenergized position;

an annular fluid flow path extending through the safety valve system axially past the outer diameter seal and the inner diameter seal; and a valve assembly moveable between an open position where fluid can flow through the annular fluid flow path, and a closed position where fluid is prevented from flowing through the annular fluid flow path.

11. The subterranean hydrocarbon development system of claim 10, further including a lock located around an outer diameter of the central body, the lock moveable between a retracted position and an extended position, wherein in the extended position the lock prevents relative axial movement between the central body and the supporting body.

12. The subterranean hydrocarbon development system of claim 11, wherein a maximum outer diameter of the central body profile with the lock in the retracted position is greater than a minimum inner diameter of the supporting profile.

13. The subterranean hydrocarbon development system of claim 10, wherein in the unenergized position, the inner diameter seal is positioned to allow relative axial movement between the cable and the production tubing with the central body profile of the central body supported by the supporting profile of the supporting body.

14. The subterranean hydrocarbon development system of claim 10, wherein in the energized position, the inner diameter seal remains axially static relative to the cable and the cable is axial moveable relative to the central body.

15. The subterranean hydrocarbon development system of claim 10, wherein the annular fluid flow path extends through the central body.

16. The subterranean hydrocarbon development system of claim 10, wherein the annular fluid flow path extends through the supporting body.

17. The subterranean hydrocarbon development system of claim 10, wherein the valve assembly is a sleeve assembly that includes an inner seal energizer moveable from an unengaged position to an engaged position, wherein in the engaged position the inner seal energizer maintains the inner diameter seal in the energized position during operation of the downhole apparatus.

18. A method of developing a subterranean well using a safety valve system, the method including:

lowering a central body having a central body profile on an outer diameter of the central body into the subterranean well;

landing the central body on a supporting profile on an inner diameter of a supporting body, the supporting profile located downhole within the subterranean well and shaped to mate with and support the central body profile of the central body;

moving a cable through the central bore of the central body, the cable lowering a downhole apparatus into the subterranean well and supporting a weight of the downhole apparatus within the subterranean well;

sealing between the central body and the supporting body with an outer diameter seal that circumscribes the central body;

moving an inner diameter seal that is located within the central bore of the central body from an unenergized position to an energized position to form a seal between the central bore of the central body and the cable that extends through the central bore;

moving a valve assembly from a closed position where fluid is prevented from flowing through an annular fluid flow path to an open position so that fluid can flow through the annular fluid flow path, wherein the annular fluid flow path extends through the safety valve system axially past the outer diameter seal and the inner diameter seal.

19. The method of claim 18, wherein moving the valve assembly from the closed position to the open position includes providing a hydraulic pressure to the valve assembly.

20. The method of claim 19, wherein a reduction of the hydraulic pressure causes the valve assembly to move to the closed position.

21. The method of claim 18, wherein in the unenergized position the inner diameter seal allows for relative axial movement between the inner diameter seal and the cable.

22. The method of claim 18, wherein in the energized position the inner diameter seal remains axially static relative to the cable and the cable is axial moveable relative to the central body.

23. The method of claim 18, wherein the annular fluid flow path extends radially outward of the inner diameter seal, radially inward of the outer diameter seal and through the central body.

24. The method of claim 18, wherein the annular fluid flow path extends radially outward of the inner diameter seal, radially outward of the outer diameter seal, and through the supporting body.

25. The method of claim 18, further including moving a lock located around an outer diameter of the central body, from a retracted position to an extended position to prevent relative axial movement between the central body and the supporting body.

* * * * *